United States Patent [19]

Kovacs

[11] Patent Number: 4,771,500

[45] Date of Patent: Sep. 20, 1988

[54] PLUMBERS SNAKE

[76] Inventor: Julius S. Kovacs, 49 Canterbury Rd., Bridgeport, Conn. 06606

[21] Appl. No.: 36,436

[22] Filed: Apr. 9, 1987

[51] Int. Cl.[4] ..... B08B 9/02

[52] U.S. Cl. ..... 15/104.33; 403/41; 403/76

[58] Field of Search ..... 15/104.33, 104.16; 403/41, 56, 76, 115, 122; 29/149.5 B

[56] References Cited

U.S. PATENT DOCUMENTS

| | | | |
|---|---|---|---|
| 1,915,679 | 6/1933 | La Motte | 15/104.33 |
| 1,978,957 | 10/1934 | Pardieck | 15/104.33 |
| 4,292,704 | 10/1981 | Joanis, Sr. | 15/104.33 |
| 4,648,733 | 3/1987 | Merkt | 403/56 |

FOREIGN PATENT DOCUMENTS

| | | | |
|---|---|---|---|
| 170901 | 3/1960 | Sweden | 403/56 |

*Primary Examiner*—Edward L. Roberts
*Attorney, Agent, or Firm*—Arthur T. Fattibene

[57] ABSTRACT

A plumbers snake having a weighted member and a connected jointed end portion which is connected to the leading end of an elongated flexible member for facilitating the threading of the elongated member through a length of pipe for clearing and/or removing an obstruction in such pipe. The weighted end and jointed members are arranged to facilitate negotiating sharp bends formed in such pipes by the jointed members being hingedly connected for movement in different planes, and which jointed portion is rendered either flexible for passing through bends or rigid to form a ram rod upon meeting an obstruction. This is attained by a jointed end portion formed of a plurality of connected links having complementary ball and socket interconnecting portions whereby the jointed end portion is rendered either flexible or rigid depending upon the form and/or nature of the obstruction encountered.

10 Claims, 2 Drawing Sheets

20
21
21A
21B
22
23
23A
24
25
26
27
28
29
30
31
2
6

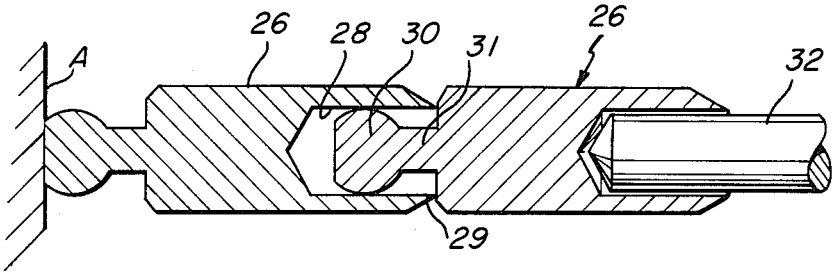
FIG. 7
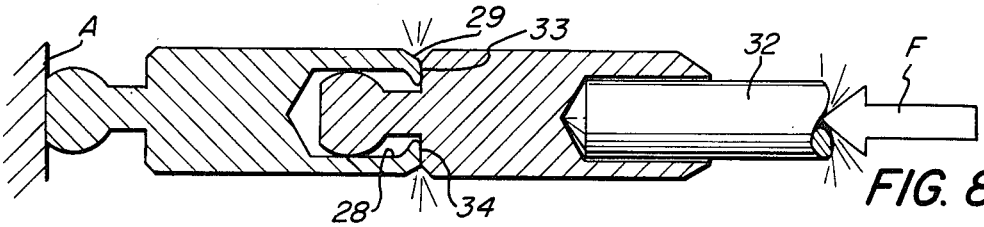
FIG. 8
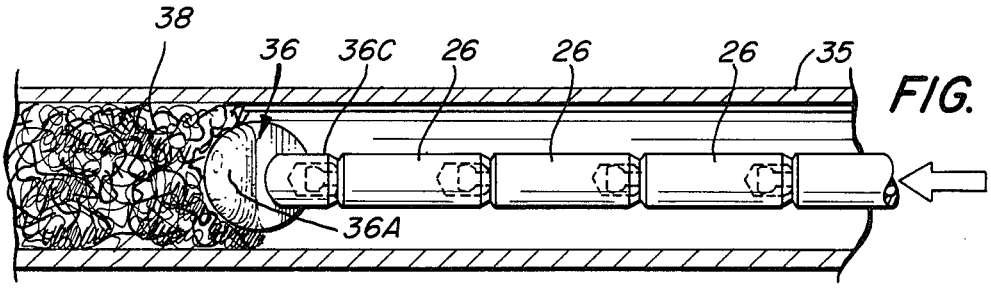
FIG. 9
FIG. 10
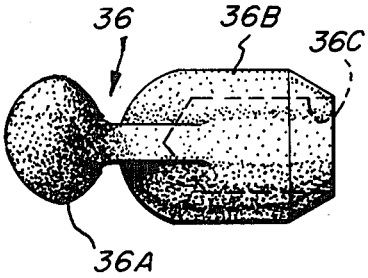
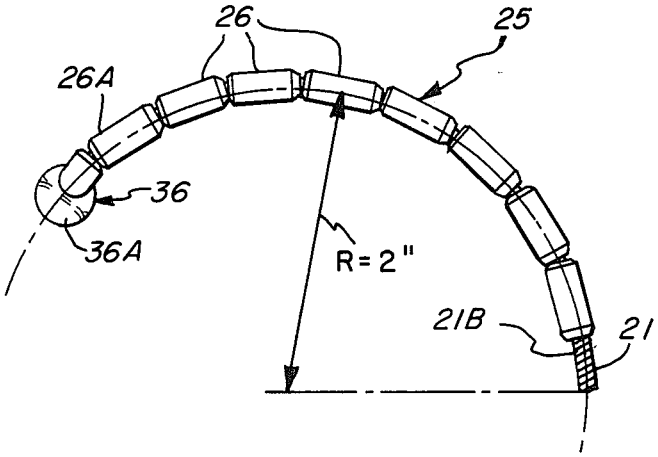
FIG. 12
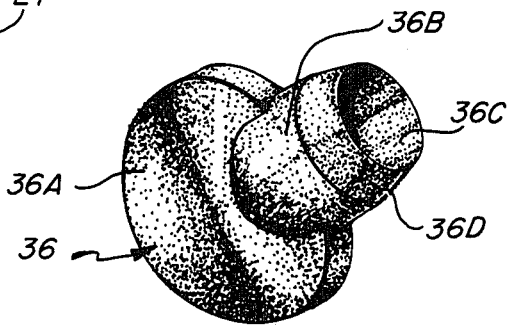
FIG. 11
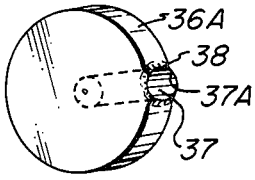
FIG. 13

PLUMBERS SNAKE

FIELD OF INVENTION

This invention relates to a plumbers snake used for dislodging obstructions in pipes, and more specifically, to an improved jointed end portion which is sufficiently flexible for facilitating the threading of a plumbers snake through a pipe and which is rendered sufficiently rigid to form a ram rod upon meeting an obstruction or blockage.

RELATED APPLICATIONS

This application is directed to a further improvement in a plumbers snake such as disclosed in my co-pending application Ser. No. 839,204 filed Mar. 3, 1986 for a Bend Following Plumbers Snake, now U.S. Pat. No. 4,692,957.

PROBLEM AND PRIOR ART

As disclosed in my above identified co-pending application, numerous efforts have been made to provide a plumbers snake that is sufficiently flexible to negotiate bends that generally occur in a particular plumbing installation and which is sufficiently capable of clearing a blockage or obstruction. The most relevant art known comprises the art referred to and/or cited in the above noted co-pending application.

OBJECTS

An object of this invention is to provide a jointed end portion of a plumbers snake that is rendered sufficiently flexible in varying planes so as to facilitate the threading of the snake through a pipe, and which is rendered rigid upon encountering an obstruction in the pipe.

Another object is to provide a jointed end portion connected to the leading end of a plumbers snake that is relatively simple in construction and positive in operation.

Another object is to provide a plumbers snake with a jointed end portion formed of a plurality of connected links which are similar in configuration.

Another object is to provide a plumbers snake having a jointed leading end portion having a series of connected links that are freely rotatable relative to each other.

Another object is to provide a plumbers snake having a jointed end portion formed of a series of similar link members which are loosely interconnected by a ball and socket interlocking arrangement.

Another object is to provide a jointed end portion of a plumbers snake formed of a series of links wherein the respective links are formed as to be rendered self-locking during the assembly thereof.

Another object is to provide a jointed end portion of a plumbers snake that is relatively simple to fabricate.

SUMMARY OF THE INVENTION

The foregoing objects and other features and advantages are attained by a plumbers snake which includes an elongated flexible member of any predetermined length having a leading end portion and a trailing end portion. Connected to the leading end of the flexible member is a jointed end portion formed of a series of links connected in tandem arranged to facilitate the threading of the flexible member through a pipe or conduit of a plumbing system. The jointed end portion is made up of a plurality of links which are essentially similar in construction. Each link includes a body portion having a socket formed in one end and a ball connector having a reduced neck portion connected to the other end thereof. The arrangement is such that the ball connector of one link is received within the socket of the next adjacent link. The arrangement is such that the depth of the socket is slightly greater than the length of the ball connector and adjacent neck portion so as to allow a limited amount of free play between adjacent links. Adjacent the open end of the socket, the body of the link is provided with a taper to define a deflectable rim to facilitate assembly. To interlock the links, the ball connector of one link is disposed in the end socket of the next adjacent link and an impact force is imparted to the links whereby the rim surrounding the socket is deflected to lock the ball connector within the socket. A weighted end member is similarly connected to the endmost link. With the links of the jointed end so assembled, the jointed portion is rendered sufficiently flexible to facilitate the threading of the snake through a pipe, and which jointed end upon encountering an obstruction, is rendered rigid to effect a ram rod.

FEATURES

A feature of this invention resides in a plumbers snake having a jointed end portion formed of similarly constructed links.

Another feature resides in a jointed end portion formed of similar links interconnected by a ball and socket connector.

Another feature resides in a jointed end portion of a plumbers snake which are loosely connected to facilitate threading the snake through a pipe.

Another feature resides in a plumbers snake having a flexible jointed end portion which is rendered rigid upon encountering an obstruction.

Other features and advantages will become readily apparent when considered in view of the drawings and specifications, in which:

FIG. 7 is a sectional side view of a pair of adjacent links to illustrate an intermediate step in the assembly thereof.

FIG. 8 is a sectional side view similar to that of FIG. 7 to illustrate the manner in which the adjacent links are interlocked during the assembly thereof.

FIG. 9 is a fragmentary side view of the jointed end illustrating the manner in which the jointed end is rendered rigid upon encountering an obstruction.

FIG. 10 is a side view of the weighted end member.

FIG. 11 is a perspective view of the weighted end member.

FIG. 12 is an end view of the jointed end portion illustrating the flexibility thereof.

FIG. 13 is a detail of construction of a modified end piece.

DETAIL DESCRIPTION

Figures 1, 2, 3, 4, 5, 6:
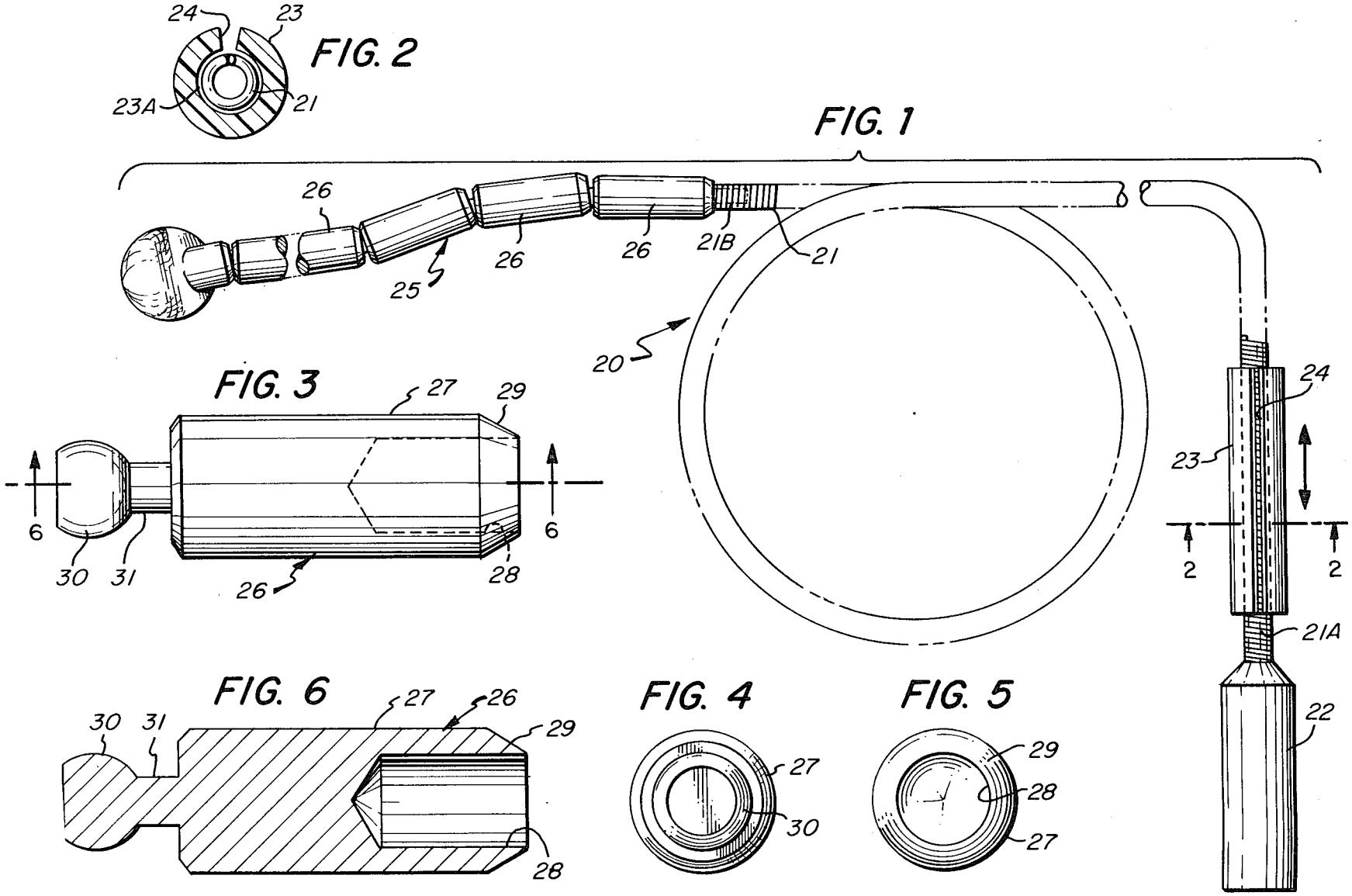
FIG. 1 is a side view of a plumbers snake embodying the present invention.
FIG. 2 is a section view taken along line 2—2 on FIG. 1.
FIG. 3 is a detail side view of a link construction.
FIG. 4 is a left end view of FIG. 3.
FIG. 5 is a right end view of FIG. 3.
FIG. 6 is a sectional side view taken on line 6—6 of FIG. 3.

Referring to the drawings, there is illustrated an embodiment of the present invention. As shown, the plumbers snake 20 comprises an elongated flexible member 21 formed of a suitable construction, e.g. a closely coiled wire or the like. Connected to the trailing end portion 21A of the flexible member 21 is a suitable handle 22 affixed thereto. Disposed on the flexible member 21 is a displaceable hand grip 23. As described in my co-pending application, above mentioned, the displaceable grip 23 is provided with a bore 23A sized so as to permit the grip 23 to slide along the flexible member 21. The grip is preferably made of a resilient material that can be readily squeezed by hand pressure to frictionally secure the grip to the flexible member 21. In the illustrated embodiment, the grip 23 is provided with a longitudinal split 24 to facilitate the placement of the grip on the flexible member 21. The arrangement is such that the flexible grip 23 can be progressively moved along the length of the flexible member as it is being threaded through a pipe to clear an obstruction, and which grip enables the operator to secure a firm grip on the snake when a force is required to be exerted on the snake to clear an obstruction.

In accordance with this invention, the snake 20 is provided with an improved jointed end porton 25. The jointed end portion 25 comprises a plurality of connected links 26. Each of the connected links are similarly constructed.

Referring to FIGS. 3 to 6, each link 26 comprises a body portion 27 which is illustrated as a generally cylindrical shape. However, it will be understood that other body shapes may be had. One end of the body 27 is provided with a socket or recessed portion 28 that extends axially thereof. The open end of the socket 28 is provided with a rim or lip 29 which is formed by tapering the end of the body 27 inwardly as shown in FIGS. 3 and 6. The other end of the body portion 27 is provided with a ball connector 30 which is spaced from the body portion by a reduced neck portion 31. It will be noted that each link 26 is thus similarly constructed.

To join the respective links 26 together to form the jointed end portion 25, the ball connector 30 of one link 26 is fitted into the socket 28 of the next adjacent link as best seen in FIG. 7. It will be noted that the socket 28 is slightly deeper than the combined length of the ball connector and its connected reduced neck portion 31. To interlock the adjacent links so joined, a stake or driving tool 32 is inserted into the end socket and a force of impact F is imparted to the tool; as the ball connector of the other link is disposed opposite an anvil or other support A. As best seen in FIG. 8, the force or impact imparted in the tool 32 drives the adjacent link 26 toward the socket of the confimed link causing the rim portion to be swagged inwardly a distance sufficient to retain the ball connector within the now partially closed socket 28. Each link is thus successively connected to its next adjacent link. As best seen in FIG. 8, the joining of adjacent links as defined caused the inturned rim 29 to define a flat bearing surface 33 which is adapted to rest flush against the face 34 of the next adjacent link. It will be apparent that with the links 26 so joined, the respective links are loosely retained to one another to provide limited free play therebetween; which is determined by the length of the reduced neck portion 31. Such free play enables the jointed end portion 25 to be sufficiently flexible to facilitate the threading of the snake 20 through a pipe or conduit 34 and to negotiate any bends commonly found in a pipe or plumbing system. FIG. 12 illustrates a typical range of flexibility attainable by the described construction. As noted in FIG. 12, the relative proportions of the links 26 are so formed so that the flexible end portion 25 can flex an amount sufficient to form an arcuate portion of a circle having a two inch radius. However, it will be understood that the radius of flexibility can vary depending upon the selected relative proportions of the component parts or links.

Connected to the endmost link 26A is a weighted member 36. The weighted end member 36 includes a bulbulous leading face portion 36A and a connected end portion 36B which includes an end socket 36C which is adapted to receive the ball connector of the leading line 26 of the flexible or jointed end portion 25. As herein before described, the rim 36D surrounding the socket 36C is tapered so that the weighted member can be secured or interlocked with the ball connector of the end most link as herein described. The bulbulous leading end of the weighted member 36 being so formed permits the snake to be threaded past the junction of two connected pipe sections and/or in passing through bends. The jointed end portion described is connected to the leading end 21B of the snake member 21 by any suitable means such as welding, bonding or fasteners.

From the foreging description, it will be noted that the flexible or jointed end portion 25 is rendered sufficiently flexible so that it can be threaded through a pipe or conduit 35 with ease. The respective links, interconnected in end to end relationship by a ball and socket connection enables the respective links to flex in varying planes relative to one another; and at the same time allows for limited play therebetween so as to create an action which enhances the displacement of slidge and/or other accumulations forming on the walls of a conduit which restricts the diameter thereof.

In the event that a blockage 38 is encountered, as noted in FIG. 9, the force imparted on the snake 20 in meeting such resistance causes the respective links to successively abut one another in face to face contact as shown therein. Because of the abutting adjacent end faces, the resultant effect is for the jointed end to stiffen up to form a ram rod of sufficient rigidity to effect dislodgement and/or a break up of the blockage 38.

If desired, the face portion 34 of the link engaging the inturned rim 33 may be provided with an annual groove (not shown) for receiving the inturned rim in a nesting relationship in the event a greater or stronger ram rod mode of operation is desired. By forming the links 26 of the jointed end of similarly constructed links renders the construction economical and simple to assemble. Also, the jointed end can be rendered both flexible and rigid depending upon the nature of the obstructions encountered.

FIG. 13 illustrates a detail of construction for a modified weighted end piece 36A. As shown, end piece 36A comprises a disc shaped member of sufficient thickness to provide a socket 37. A thin rim or lip 38 projecting slightly outwardly defines the socket opening 37A.

To assemble end piece 36A to the end most link 26, the ball connector 30 of the end most link is inserted into socket 37. The end piece 37 is attached to the end link in the same manner as herein before described. An impact or force is applied to the end link which results in the rim or lip 38 being turned inwardly to retain the ball connector within socket 37. In all other respects, the construction of the snake is as hereinbefore described.

While the invention has been described with respect to a particular embodiment thereof, variations and modifications may be made without departing from the spirit or scope of the invention.

What is claimed is:

1. A plumbers snake comprising an elongated flexible member having a leading end and a trailing end, means defining a jointed end portion connected to the leading end of said flexible member, said jointed end portion including a plurality of links disposed in tandem wherein the adjacent ends of said link include complementary interconnecting means, wherein each of said links include a solid elongated member, a socket formed in one end of said member, and a ball connector having a reduced neck portion connected to the other end of said member whereby the socket of one member loosely retains the ball connector of the next adjacent member to form said complementary interconnecting means, and said interconnecting means imparting angular flexibility to said jointed portion on one mode of operation.

2. A plumbers snake as defined in claim 1; wherein said interconnecting means renders said jointed portion rigid and non-flexible in another mode of operation.

3. A plumbers snake as defined in claim 1, wherein each of said links are similar in construction.

4. A plumbers snake as defined in claim 1 and including a weighted member, and said weighted member being flexibly connected to the endmost link.

5. A plumbers snake comprising:

an elongated flexible member having a leading end and a trailing end, means defining a jointed end portion connected to the leading end of said flexible member, said jointed end portion including a plurality of links disposed in tandem wherein the adjacent ends of said link include complementary interconnecting means, said interconnecting means imparting angular flexibility to said jointed portion in one mode of operation, wherein each of said links comprises a link member having a body portion and a socket formed in one end thereof, and a ball connector projecting from the other end thereof wherein the ball connector of one link is fitted and retained in the socket of the next adjacent link, said ball connector includes a reduced neck portion for spacially connecting said ball connector to said body portion, and wherein said socket has a depth which is greater than the combined length of said ball connector and reduced neck portion.

6. A plumbers snake comprising an elongated flexible member having a leading end and a trailing end, means defining a jointed end portion connected to the leading end of said flexible member, said jointed end portion including a plurality of links disposed in tandem wherein the adjacent ends of said link include complementary interconnecting means, said interconnecting means imparting angular flexibility to said jointed portion in one mode of operation, and including a weighted member, and said weighted member being flexibly connected to the endmost link, wherein said weighted member having a generally bulbulous free end portion and a connecting end portion, said connecting end portion having a socket formed therein for loosely receiving and retaining said weighted member to the endmost link of said jointed end portion.

7. A plumbers snake comprising an elongated flexible member having a leading end and a trailing end, means defining a jointed end portion connected to the leading end of said flexible member, said jointed end portion including a plurality of links disposed in tandem wherein the adjacent ends of said link include complementary interconnecting means, said interconnecting means imparting angular flexibility to said jointed portion in one mode of operation, wherein each of said links comprises a link member having a body portion and a socket formed in one end thereof, and a ball connector projecting from the other end thereof wherein the ball connector of one link is fitted and retained in the socket of the next adjacent link, wherein the respective sockets in said links include an inwardly deformed peripheral rim portion to define a retainer for loosely retaining the ball connector of the next adjacent link within said socket.

8. A plumbers snake as defined in claim 7, wherein said peripheral rim portion includes an outer conical surface.

9. A plumbers snake comprising an elongated flexible member of a predetermined length, said elongated member having a leading end and a trailing end, a jointed end portion connected to said leading end, said jointed portion including a plurality of similarly constructed links, said links being disposed in tandem, each of said links including a body portion having a socket formed in one end thereof, and a ball connector having a reduced neck portion connected to the other end of said body portion, said socket loosely retaining the ball connector of the next adjacent link, said neck portion permitting limited axial and/or rotational movement between the adjacent links, whereby said jointed end portion is rendered flexible in one mode of operation and rigid and non-flexible in another mode of operation, and a weighted member connected to the endmost link.

10. A plumbers snake comprising an elongated flexible member of a predetermined length, said flexible member having a leading end and a trailing end, a handle connected to said trailing end, and a displaceable grip slidably connected on said flexible member, a jointed end portion connected to the leading end of said flexible member, said jointed end portion including a plurality of similarly constructed links, each of said links having a body portion, an axially disposed socket formed in one end of said body portion, said body portion having a tapering lip circumscribing the open end of said socket, and a ball connector having a reduced neck portion axially connected to the other end of said body portion, said neck portion spacing said ball connector from said other end of said body portion, said socket having a diameter sized to accommodate the ball connector of an adjacent link, said socket having a depth which is slightly greater than the combined length of said ball connector and reduced neck portion, said lip being inwardly bent to retain said ball connector on one link within the socket of the next adjacent link, and a bulbulous weighted member connected to the endmost link, said weighted member having a socket formed on one end thereof, said last mentioned socket receiving the ball connector of said endmost link.

* * * * *